United States Patent [19]

Ahad et al.

[11] Patent Number: 4,793,643

[45] Date of Patent: Dec. 27, 1988

[54] DOOR CLOSING AND LOCKING MECHANISM

[75] Inventors: Munir J. Ahad, Valencia; Sven A. Pettersson, Santa Monica, both of Calif.

[73] Assignee: Adams Rite Products, Inc., Glendale, Calif.

[21] Appl. No.: 25,973

[22] Filed: Mar. 16, 1987

[51] Int. Cl.[4] ..... E05C 3/04

[52] U.S. Cl. ..... 292/241; 292/240; 292/207; 292/341.17; 292/DIG. 49

[58] Field of Search ..... 292/241, 240, DIG. 7, 292/207, 341.17, 304, 340, DIG. 49; 244/120

[56] References Cited

U.S. PATENT DOCUMENTS

| | | | |
|---|---|---|---|
| 1,283,350 | 10/1918 | Stiles | 292/340 X |
| 2,919,569 | 1/1960 | Davis | 292/240 |
| 2,926,399 | 3/1960 | Ramunas | 292/241 |
| 3,490,804 | 1/1970 | Little | 292/240 |
| 3,563,588 | 2/1971 | Putsch et al. | 292/340 X |
| 4,265,474 | 5/1981 | Poe | 292/241 |
| 4,389,062 | 6/1983 | Rosenberg | 292/241 X |

FOREIGN PATENT DOCUMENTS

| | | | |
|---|---|---|---|
| 0010821 | 5/1980 | European Pat. Off. | 292/241 |
| 530209 | 12/1940 | United Kingdom | 292/241 |
| 893031 | 4/1962 | United Kingdom | 292/241 |

*Primary Examiner*—Gary L. Smith
*Assistant Examiner*—Curtis B. Brueske
*Attorney, Agent, or Firm*—Whann & Connors

[57] ABSTRACT

Disclosed is a mechanism for closing and locking two doors of the cowling of an aircraft engine. This mechanism includes a bolt which is received in a chamber of a receptacle. The bolt is connected to one door and the receptacle is connected to the other door so that, upon closure of the two doors, the bolt slips into the chamber. A cam attached to a rotary member housed within the chamber enables a single mechanic to close the doors and lock them snugly. This cam engages a finger on the bolt upon rotation of the rotary member which draws the bolt into the chamber by pulling against the finger. The cam moves into an over center position which securely locks the bolt in place without locking bolt travel. A locking device is additionally provided for locking the rotatable member in position when the bolt is locked in place. This locking device has a plunger which provides audible signals when the cam is in the fully opened position and when the mechanism is securely locked.

11 Claims, 6 Drawing Sheets

FIG. 5
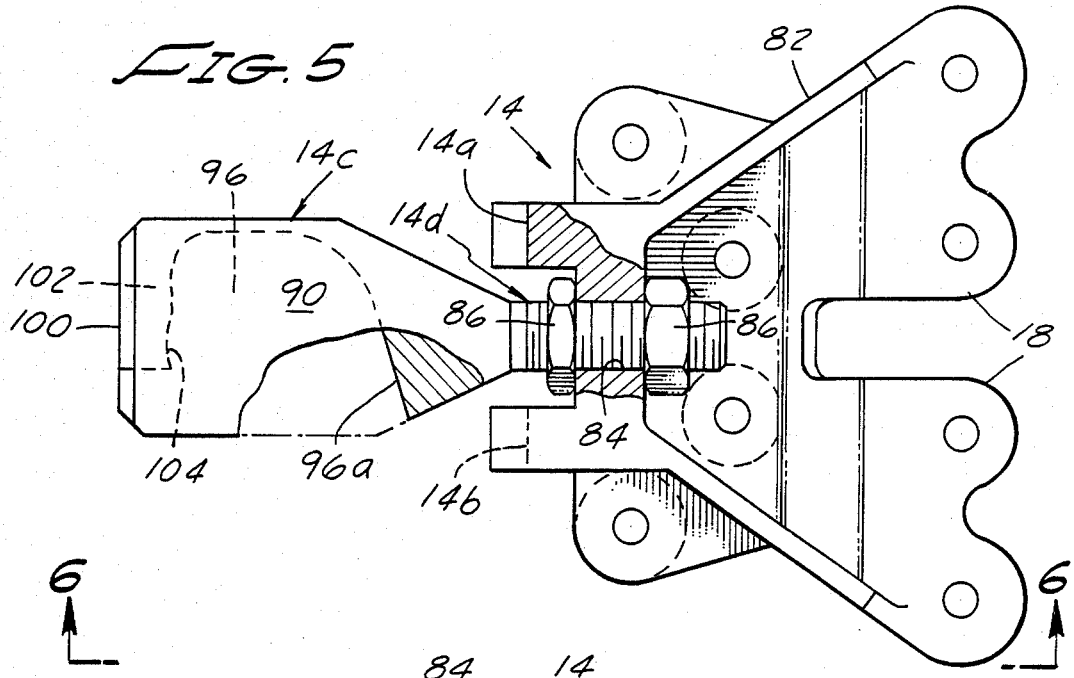
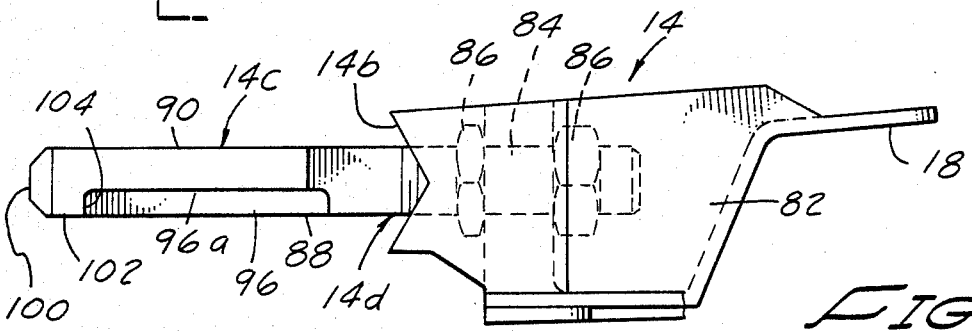
FIG. 6
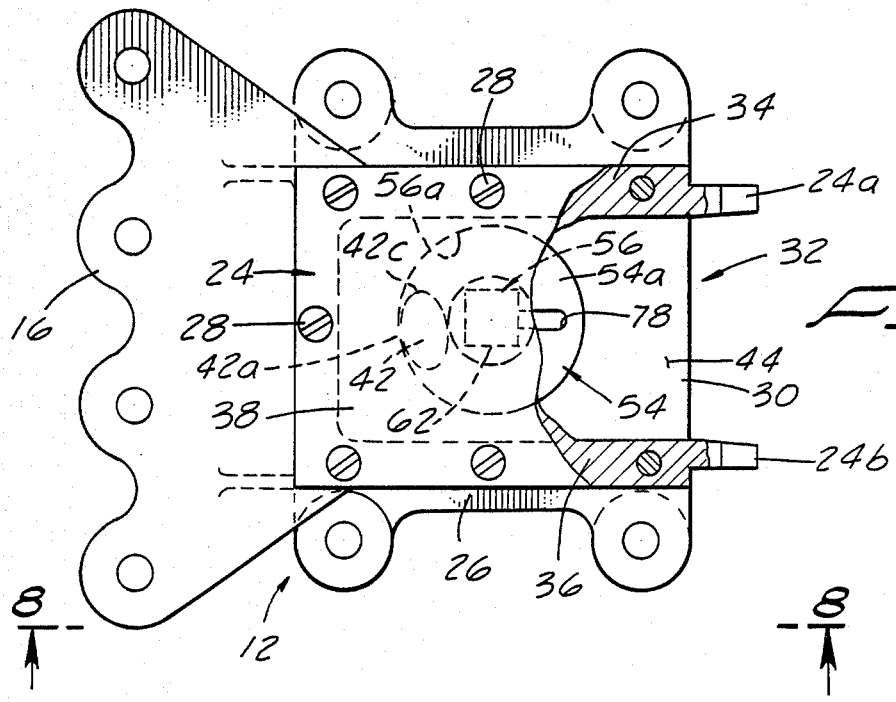
FIG. 7

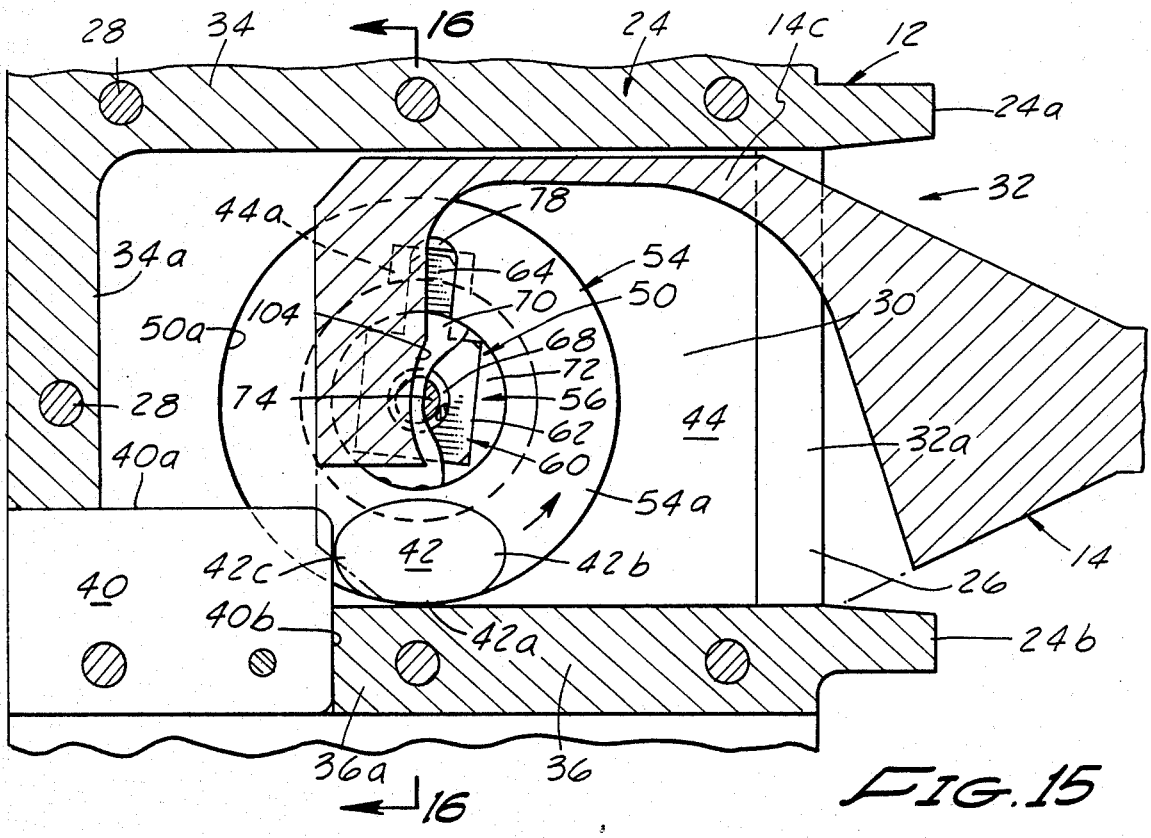
FIG. 15
FIG. 16
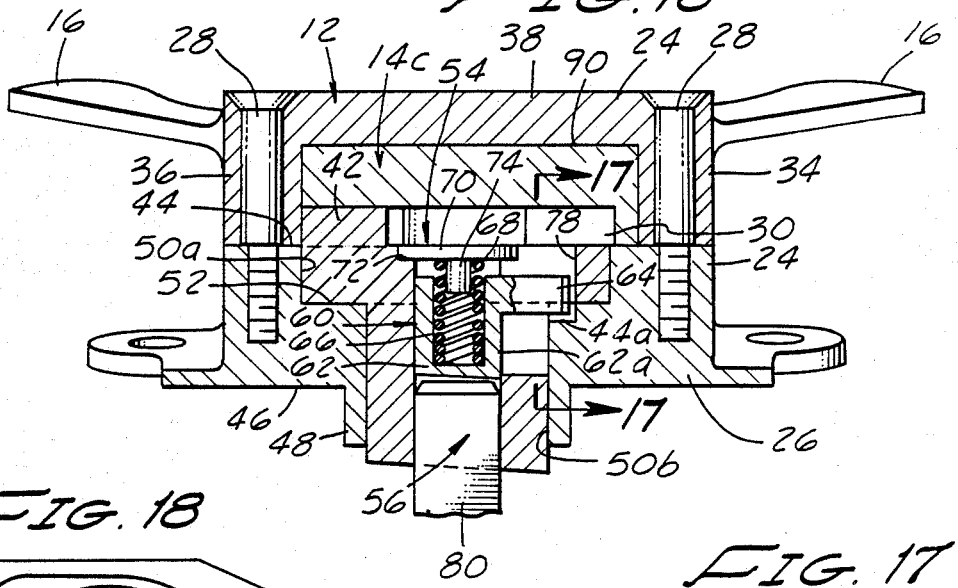
FIG. 18
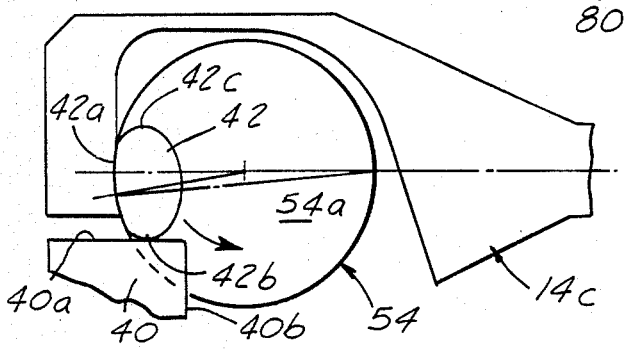
FIG. 17
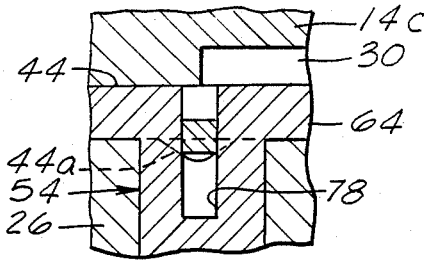

DOOR CLOSING AND LOCKING MECHANISM

BACKGROUND OF THE INVENTION

1. Field of the Invention

This invention relates to a door closing and locking mechanism, particularly to a door closing and locking mechanism used to facilitate one man closure and locking of the doors of a cowling for an aircraft engine.

2. Background Discussion

It is conventional for an aircraft engine to be housed within a cowling structure. This cowling structure has hinged edges and has the complementary bolt and latch elements disposed opposite each other on the opposed closing edges of the doors. After the engine has been serviced, the mechanic closes the doors so that the closing edges will be adjacent each other. The conventional bolt and latch mechanism requires more than one mechanic to force these closing edges into proximity with each other to enable it to be locked. This is undesirable because of the additional manpower required.

SUMMARY OF THE INVENTION

The problem discussed above has been obviated by the present invention which enables one man to close and lock securely the two doors of the cowling for an aircraft engine. There are several features of this invention, no single one of which is solely responsible for its desirable attributes. Without limiting the scope of the invention, as expressed by the claims, its more prominent features will now be discussed briefly. After considering this discussion, and particularly after reading the section of this patent application entitled DETAILED DESCRIPTION OF THE PREFERRED EMBODIMENT, one will understand how the features of this invention provide a door closing and locking mechanism which may be conveniently operated by one man. One man without any assistance may move the two doors of the cowling adjacent each other so that the spacing between the closing edges of the door is approximately three-quarters ($\frac{3}{4}$) of an inch. Moving the closing edges closer together, however, requires additional manpower.

This invention employs a bolt member which is aligned with a receptacle member that has a chamber therein which receives the bolt member. The major feature of the present invention is that it is designed so that with the closing edges of the doors spaced three-quarters ($\frac{3}{4}$) of an inch or even greater, the leading edge of the bolt member will be in the mouth of the chamber of the receptacle. This will be the normal starting position for operation of the mechanism. With the closing edges of the door spaced this substantial distance apart, a single mechanic using a conventional wrench, can secure the doors, with the closing edges being brought into abutting relationship and the mechanism locking the door closed. Consequently, a significant savings in manpower is achieved.

The second feature of this invention is a cam which is moved into an over center position that insures locking of the bolt member in place. This cam is carried on a rotary element received within the chamber and is positioned so that, after the bolt member is moved to the starting position, the cam will engage a finger element on the bolt member and will ride along the cam surface as the rotary element is rotated, pulling the bolt member into the chamber of the receptacle. The rotary element is rotated by means of a wrench. As the rotary element is turned, the finger element rides over the cam's surface, with the cam moving to a closed position where the center of the cam's surface is below the centerline of the rotary element. The cam engages a stop in this position. With the cam in this position any force acting on the bolt member to pull it from the chamber turns the rotary element in a direction which forces the cam more firmly against the stop. This is because the force tending to pull the bolt member from the receptacle chamber acts through the center of the cam surface. Thus, a failsafe feature preventing accidental opening of the mechanism is inherent in the cam design.

The third feature of this invention is the use of a locking device to lock the rotary element in position when the bolt is locked in place. This is an additional safety feature which further insures that the cowling doors will be securely locked together. This locking device includes a plunger which is springloaded. When the rotary element has been moved to the locking position, the spring-loaded plunger is forced into a slot which locks the rotary element into position. The wrench is used to move the plunger against the force of the spring and turn the rotary element when it is desired to disengage the bolt member from the receptacle member. Preferably, this plunger element provides a "click" sound, signaling the mechanic, when the cam has been moved into the open position and into the locked position.

BRIEF DESCRIPTION OF THE DRAWING

The door closing and locking mechanism of this invention is illustrated in the drawing, with like numerals indicating like parts, and in which:

FIG. 5 is a plan view of the bolt member of the present invention;

FIG. 6 is a side view taken along line 6—6 of FIG. 5;

FIG. 7 is a plan view of the receptacle member of the present invention;

FIG. 15 is a cross-sectional view, with sections broken away, similar to that shown in FIG. 11, but with the bolt member just in the mouth of the receptacle member ready to be moved to the closed and locked position as shown in FIG. 11;

FIG. 16 is a cross-sectional view taken along line 16—16 of FIG. 15;

FIG. 17 is a cross-sectional view taken along line 17—17 of FIG. 16;

FIG. 18 is a schematic view showing the failsafe locking provided by the over center cam device of the present invention.

DESCRIPTION OF THE PREFERRED EMBODIMENT

Figure 1:
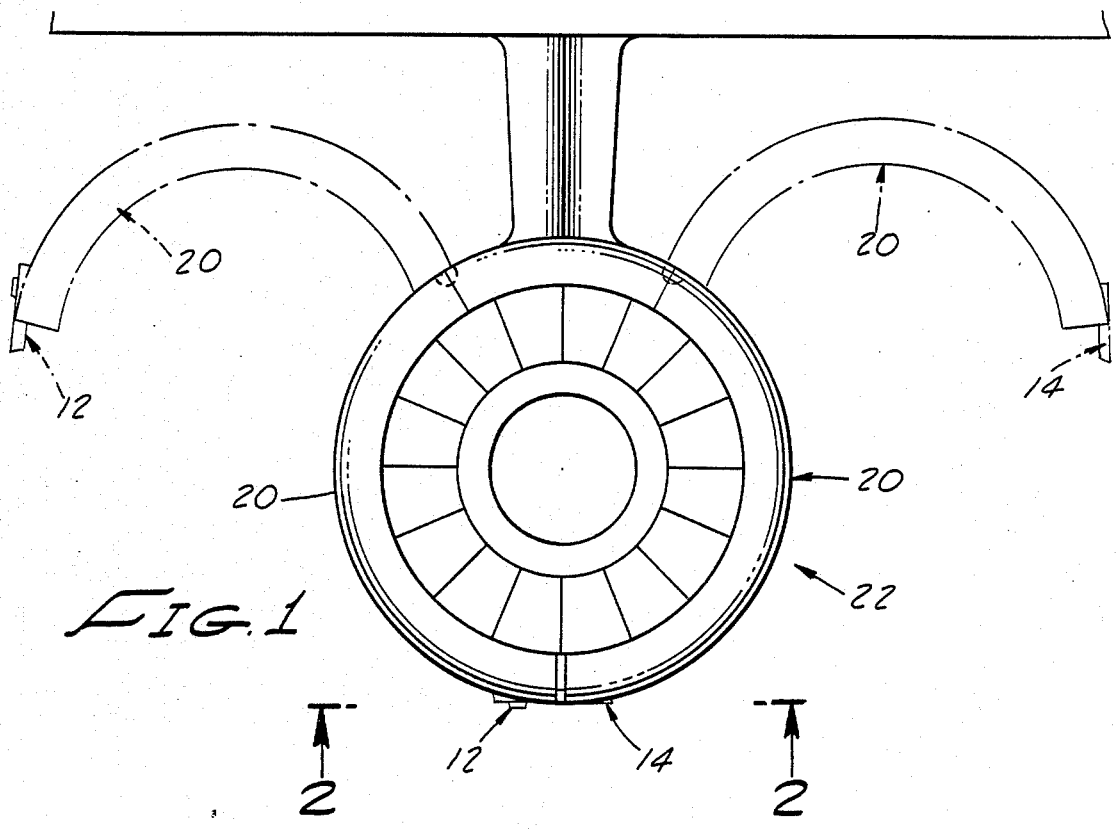
FIG. 1 is a front elevational view of a cowling structure for an aircraft engine, with the cowling doors shown in phantom lines in the open position.
Figure 2:
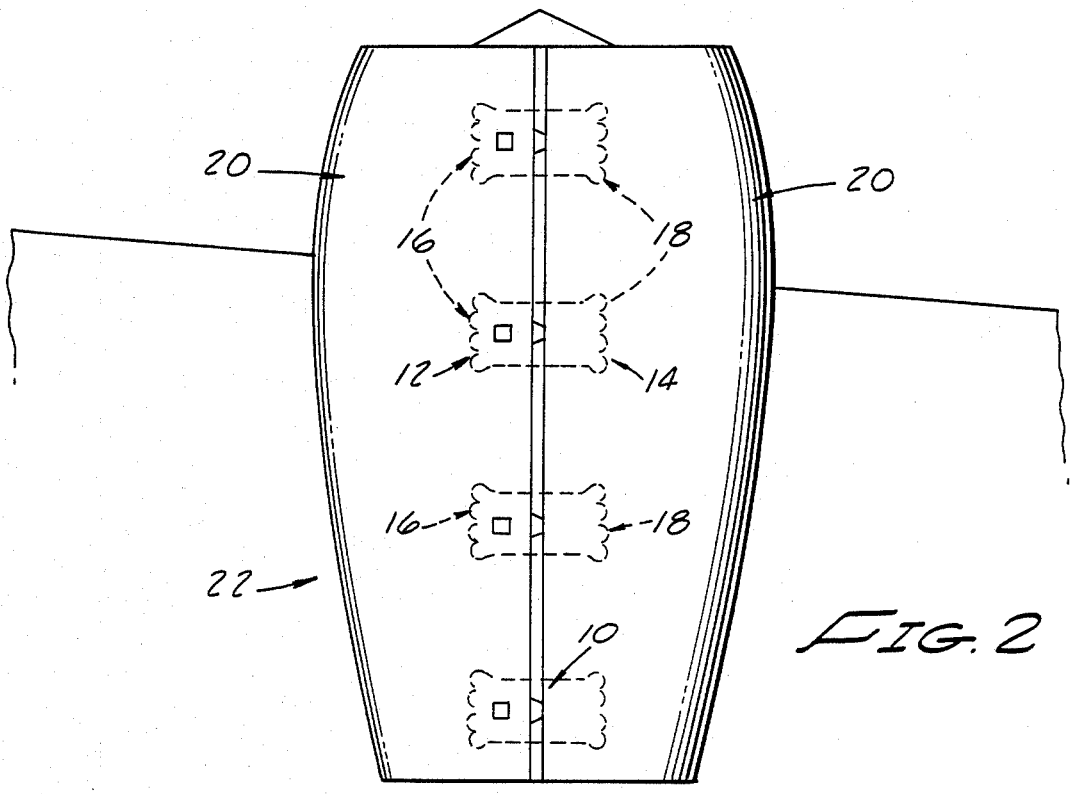
FIG. 2 is a view taken along line 2—2 of FIG. 1.
Figures 3, 3A, 4:
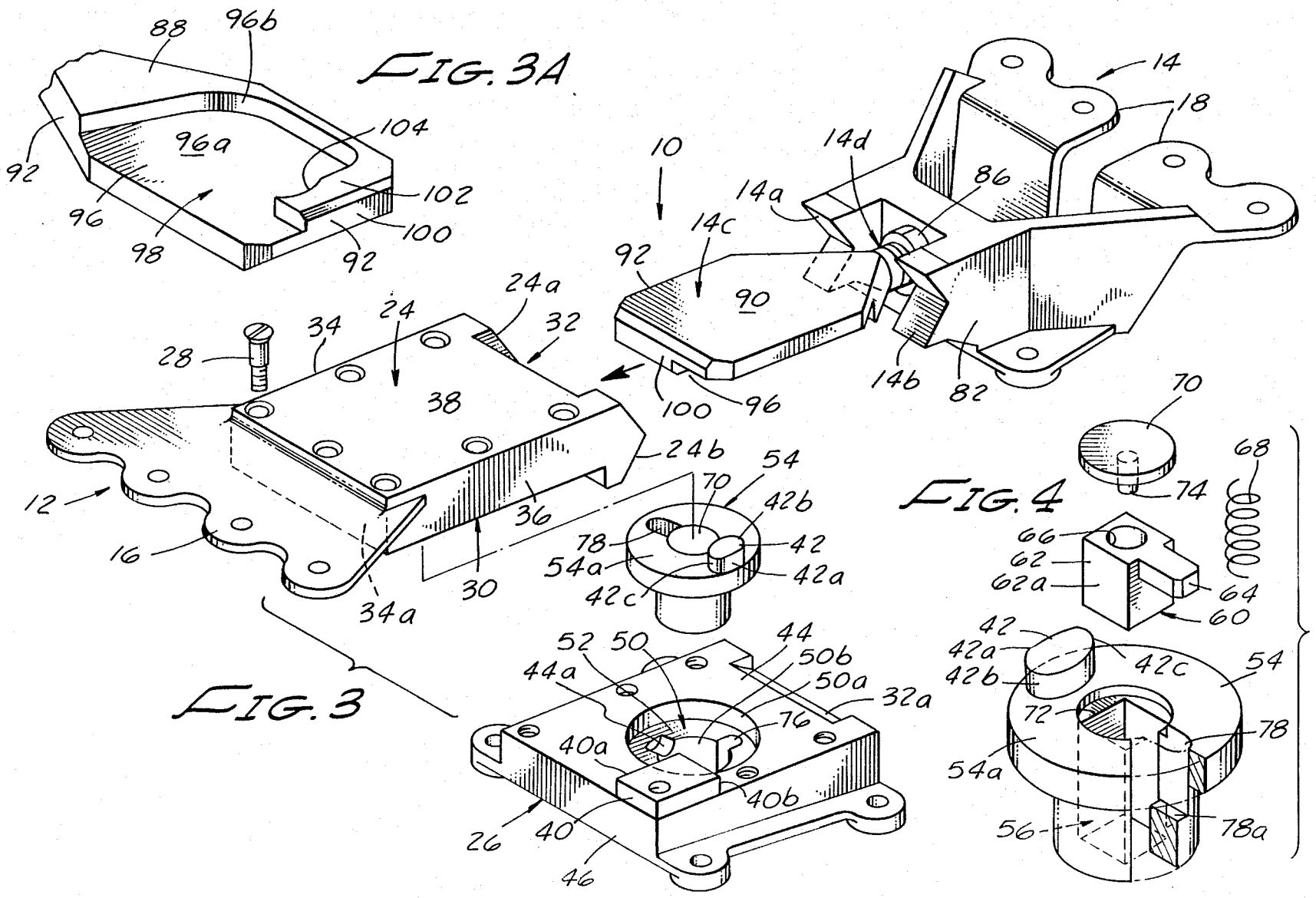
FIG. 3 is an exploded perspective view of the closure and lock mechanism of the present invention.
FIG. 4 is an exploded perspective view, with sections broken away, of the rotary element used in the closure and locking mechanism of the present invention.
Figure 9:
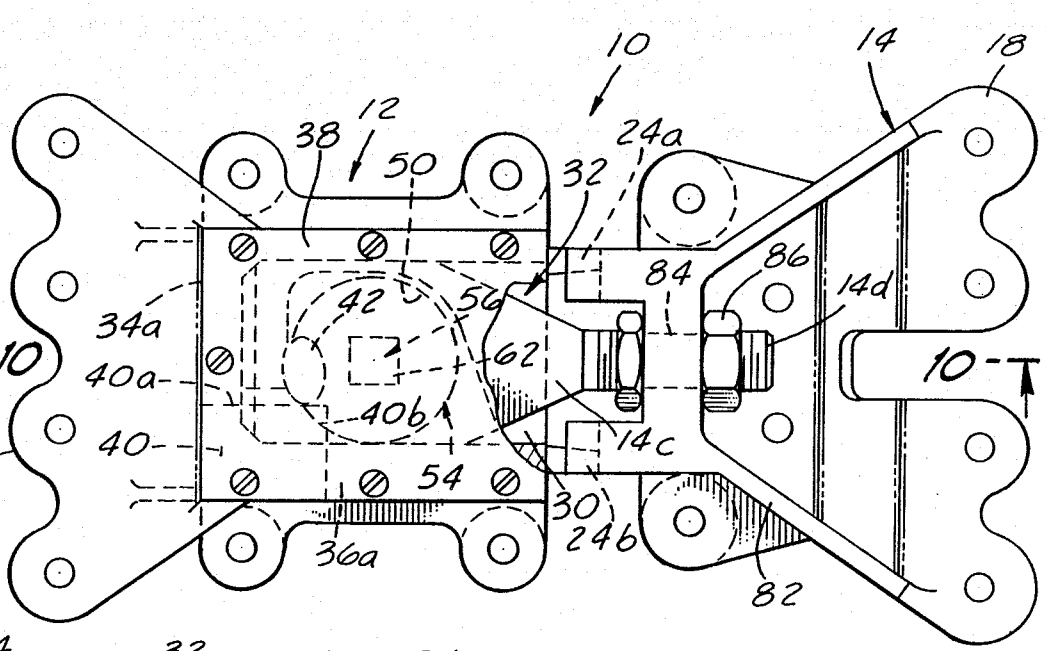
FIG. 9 is a plan view of the bolt member received and locked in position within the receptacle member.
Figure 8:
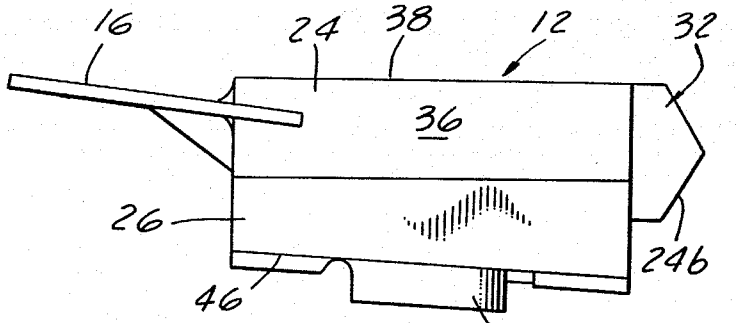
FIG. 8 is a side view taken along line 8—8 of FIG. 7.

As best illustrated in FIG. 3, the door closure and locking mechanism of this invention has two major components: a receptacle member 12 and a bolt member 14, including bolt 14*c*. Each of these members include, respectively, flanges 16 and 18 which enable them to be attached to the doors 20 of an engine cowling 22 shown in FIGS. 1 and 2. They are aligned with each other so that upon closure of the doors 20 they coact to lock the doors securely together. In accordance with the principal advantage of this invention, the doors 20 may be moved adjacent to each other by one mechanic, who can then actuate manually the door closure and locking mechanism 10 without the assistance of other workers.

As best shown in FIGS. 3, 7, 8 and 10, the receptacle member 12 includes inside and outside sections 24 . and 26 which are secured together along their respective edges with a series of screws 28. With the two sections 24 and 26 secured together, they form within the receptacle member 12 a chamber 30 adapted to receive the bolt member 14. This chamber 30 has an open mouth 32 with the lips 32*a* of the mouth being tapered inwardly to facilitate entrance of the bolt member 14 into the chamber 30. The tips 24*a* and 24*b* of the section 24 are on opposite sides of the mouth 32 and are V-shaped to mate with corresponding V-shaped sockets 14*a* and 14*b* in the bolt member 14 on closing of the mechanism 10.

The inside section 24 includes a pair of opposed walls 34 and 36 which extend outwardly from a plate 38. The one wall 34 has a generally L-shaped cross section, providing a back section 34*a*, as shown in FIG. 15. The other wall 36 is relatively straight having an offset end 36*a*. At the junction between the back section 34*a* and the offset end 36*a* is secured a block 40. The block 40 is of a rectangular cross section, with two of its adjacent side edges 40*a* and 40*b* protruding into the chamber 30 and serving as stops for an elliptical cam 42. This aspect of the invention will be described in greater detail hereinafter.

The outside section 26 of the receptacle member is a block having a generally flat inside surface 44 which abuts the ends of the walls 34 and 36 of the inside section 24. This inside surface 44 has a slight indentation 44*a* therein with beveled sides. The outer surface 46 of this section 26 has a raised annular hub 48. There is an annular opening 50 extending between the two surfaces 44 and 46 through the hub 48. This opening 50 has an enlarged inner circular wall 50*a* and a small outer circular wall 50*b* with a ledge 52 joining these circular walls 50*a* and 50*b*.

Figure 11:
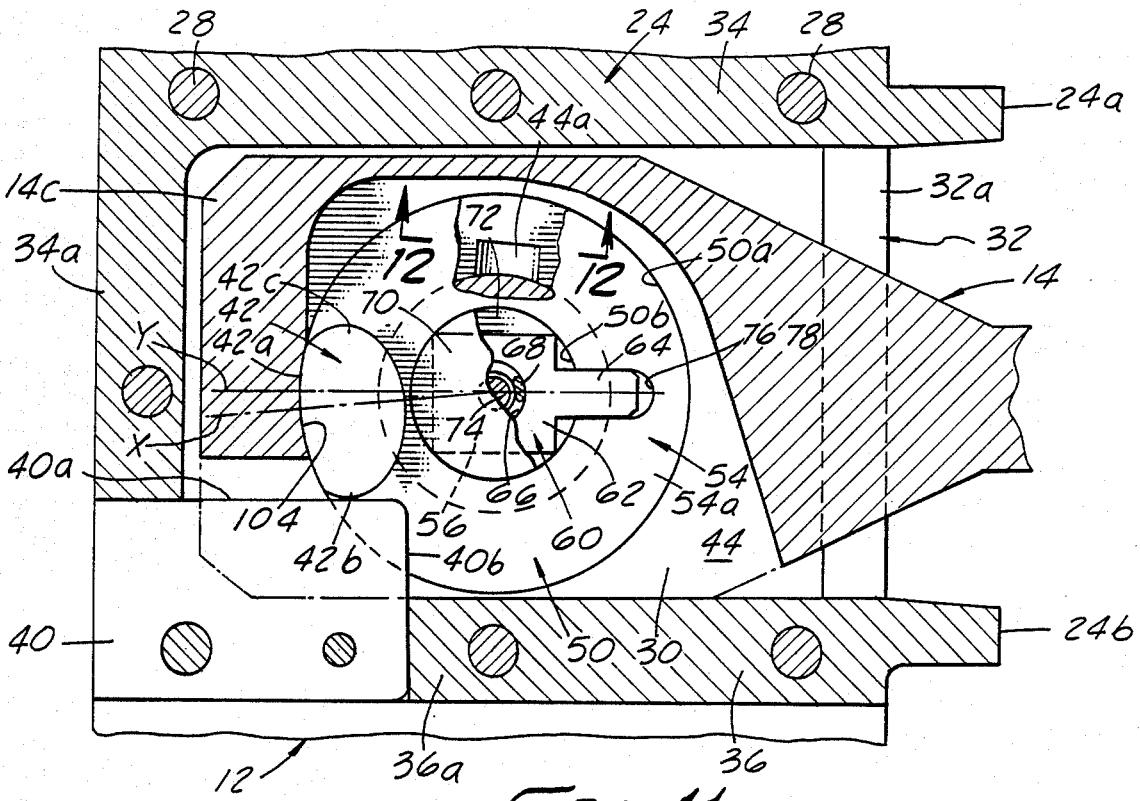
FIG. 11 is a cross-sectional view taken along line 11—11 of FIG. 10, with sections broken away.
Figure 12:
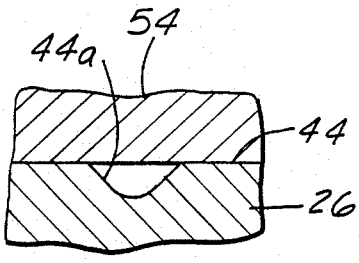
FIG. 12 is a cross-sectional view taken along line 12—12 of FIG. 11.

Seated within the opening 50 is a rotary element 54. This rotary element 54 has an internal central bore 56 with a generally square cross section and an outer annular configuration which conforms to the general shape of the annular opening 50 in the hub 48. The inner face 54*a* of the rotary element 54 carries the raised cam member 42 which has a generally elliptical shape. The outer arcuate surface 42*a* of the cam member 42 is coextensive with the circular perimeter of the rotary element 54. As shown in FIGS. 11 and 15, as the rotary element is rotated manually, the cam member 42 moves between the two positions illustrated. In the position shown in FIG. 11 the end 42*b* of the cam member 42 abuts the side 40*a* of the block 40. In the position shown in FIG. 15, the end 42*c* of the cam member 42 abuts the side 40*b* of the block 40.

As best shown in FIGS. 4, 10, 11, 15 and 16, there is a locking device 60 seated in the central bore 56 of the rotary element 54. This locking device 60 includes a plunger 62 having a generally square cross section with an arm 64 extending outwardly from the plunger body 62*a* received within the bore 56. This locking device 60 has a central cavity 66 which receives a coiled spring 68 that extends outwardly from this cavity and engages the underside of a disk 70 seated on a ledge 72 surrounding the inner open end of the bore 56. This disk 70 is force fitted into the annulus surrounding the ledge 72. It carries on its inside a pin 74 which is integral with the disk 70 and is received on the side of the coiled spring 68. There is a slot 76 extending into the body of the outer section 26 from the opening 50 and another slot 78 extending into the body of the rotary element 54 which coact with the arm 64 as the rotary element is turned. This feature of the invention will now be discussed in connection with FIGS. 10, 11, 15 and 16.

Figure 10:
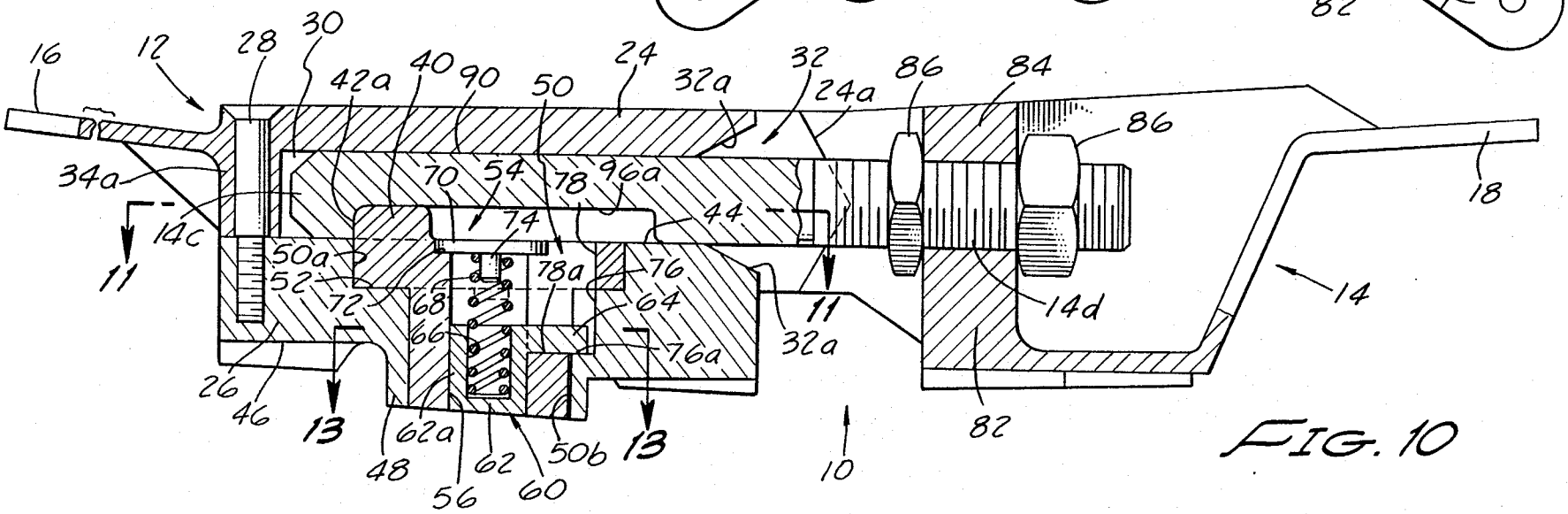
FIG. 10 is a cross-sectional view taken along line 10—10 of FIG. 9.
Figure 14:
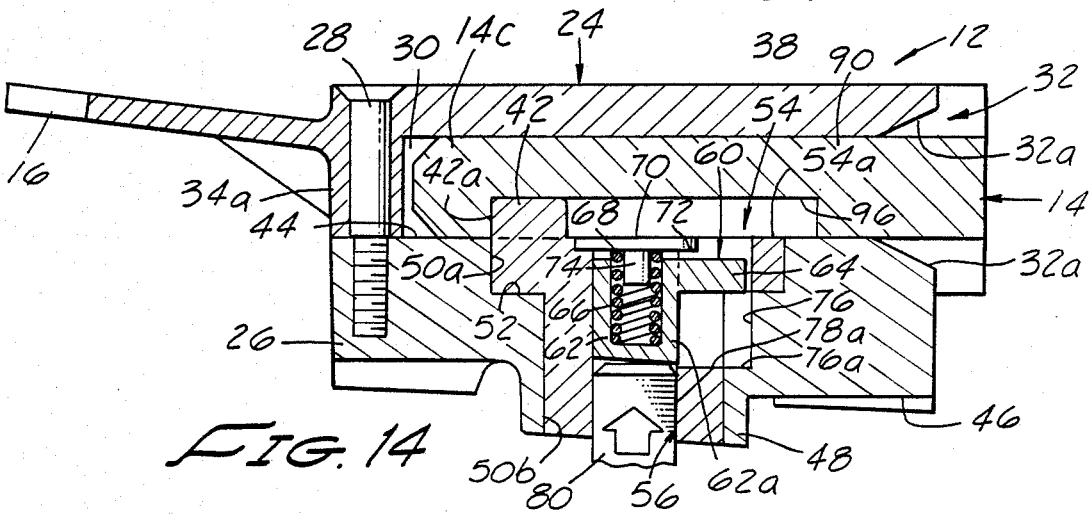
FIG. 14 is a cross sectional view similar to that shown in FIG. 10, but with the plunger assembly moved inwardly to alloy the rotary element to be turned.

FIGS. 10 and 11 show the locking device 60 in the locked position where the cam member 42 has been moved to the locked position holding the body member 14 in the locked position. As shown in FIG. 10, the arm 64 of the plunger 62 is received in the slot 76 in the outer section 26 with the coiled spring 68 pushing the plunger 62 outwardly. The bases 76*a* of the slot 76 and 78*a* of slot 78 act as a stop. In this position the slot 78 in the rotary element 54 is aligned with the slot 76. Using the wrench 80 to push the plunger 62 inwardly as shown in FIG. 14 will cause the arm 64 to shift its position and move from slot 76 into slot 78. Upon rotation of the rotary element 54 by turning the wrench 80, the arm will now bear against the side wall of the slot 78 and move over the surface 44 until the cam member 42 has been moved to the position shown in FIG. 15. At this point the arm 64 will slip into the indentation 44*a* in the face 44, providing an audible signal indicating that the cam member 42 is now in the open position. As the rotary element 54 rotates, the bolt 44*c* moves from the position shown in FIG. 11 to the position shown in FIG. 15, opening the doors 20 of the cowling 22.

As best illustrated in FIGS. 3, 5 and 6, the bolt member 14 includes the bolt 14*c* having at its rear end a screw element 14*d* which is received in a cylindrical socket 84 in the body 82 of the member 14. Two nuts 86 are used to secure the bolt 14*c* to the body 82.

As best shown in FIGS. 3A and 3, the bolt 14*c* has a face surface 88 and a back surface 90 which are generally planar and parallel to one another, with the two faces projecting outwardly to define therebetween a solid section 92 having a thickness just slightly less than the width of the mouth 32 and a depression 96 therein. This depression 96 has a base 96*a* surrounded by a wall 96*b* defining an open section 98 between the opposed ends of the wall. This open section 98 between the forward end of the wall 96*b* and the leading edge 100 of the bolt 14*c* is a finger element 102 which has a generally hook shape to facilitate grabbing the cam element 42. The inside wall 104 of the finger 102 is a portion of the wall 96*b* and is a curved cam surface which has an arc which conforms to the circumference 42 of the circle on which the cam surface 42*a* lies. The center of this cam surface 42*a* will be below, that is, in the over center position, when the bolt 14*c* is locked in place as shown in FIG. 11. Moreover, the inside wall 104 will abut and coincide with the cam surface 42*a*. This prevents loss of travel ween the mechanism is locked. Ordinarily, with the cam element 42 in the over center position there would be some loss of travel of the bolt 14*c* in the locking direction. Using the two matching curved cam surfaces eliminates this loss of travel. In other words, when the bolt 14*c* has been moved to the furthest possible position to the left as viewed in FIG. 11 (the limit position), the over center positioning of the cam element 42 will not move the bolt from this limit position. Thus, the edges of the doors 20 are maintained snugly together

OPERATION

The door closing and locking mechanism 10 of this invention is very convenient to use and enables one mechanic to service an engine enclosed by the heavy cowling doors 20. The mechanic after servicing the engine will manually move the two cowling doors 20 towards each other so that the closing edges of the two doors are adjacent each other with the leading edge 100 of the bolt 14*c* just in the open mouth 32 of the chamber 30 as shown in FIG. 15. The spacing between the closing edges of the doors 20 will be approximately three-quarters of an inch, or even greater. The spacing between the closing edges of the doors 20 will be determined by the diameter of the rotary element 54. Rotation of element 54 moves the closing edges of the two doors 20 together so that they abut. To close these doors completely, if done manually, it would require two or even more workers to force the doors together so that their closing edges abut. The mechanism 10 of this invention eliminates the need for this additional manpower.

With the doors 20 adjacent each other and the bolt 14*c* in the position shown in FIG. 15, the plunger 62 will be in the unlocked position as illustrated in FIG. 16. The mechanic now takes a wrench 80 with a square socket and pushes it into the bore 56. The square socket is received in the square bore 56, enabling the mechanic to now rotate the rotary element 54 in a counterclockwise direction as viewed in FIG. 15. Upon rotation of the rotary element 54, the cam 42 will engage the cam surface wall 104, pushing against the finger 102 to draw the bolt 14*c* into the chamber 30 as the rotary element 54 is manually turned. The wrench 80 provides leverage to overcome the resistance of the cowling doors 20 to closure. As the rotary element 54 is continued to be turned, the cam surface 42*a* will ride against the cam surface of the wall 104 until the cam end 42*b* engages the stop side 40*a* of the block 40.

As best shown is FIGS. 11 and 18, the cam 42 is now in the locking position with the center X of the cam surface 42*a* below the center line Y of the rotary element 54. This is the over center position, with the two cam surfaces lying on the circumference of the circle inscribed by the path of travel of the edge 54*a* of the rotary element 54 and their respective centers coinciding. With the cam 42 in this over center position, any force acting on the bolt 14*c* which tends to pull this bolt 14*c* from the chamber 30 has its vector passing through the center point of the matching cam surfaces. This force acts in both a downwardly and a rearwardly direction. The downward component of the force thus pushes the cam and edge 42*b* more firmly against the stop side 40*a*, holding the bolt 14*c* in position rather than tending to pull it from the chamber 30. If the center of the cam surface was above the center line Y, a rearward acting force on the bolt member 14 would tend to turn the rotary element 54 in a clockwise direction, as viewed in FIG. 11.

Figure 13:
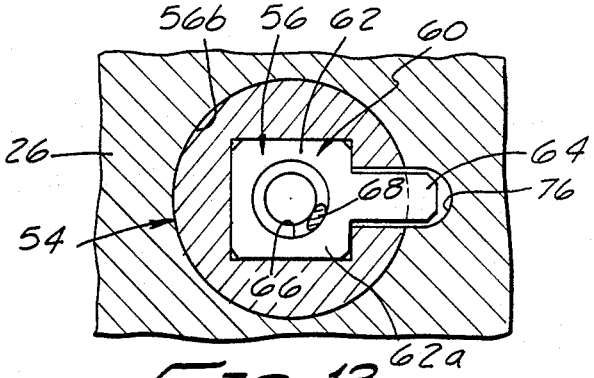
FIG. 13 is a cross-sectional view taken along line 13—13 of FIG 10.

As an additional safety measure, the locking device 60 provides for positive locking of the rotary element 54 in position when the cam 42 has been moved to the locked position as shown in FIG. 11. When the mechanic turns the rotary element 54 to the position shown in FIG. 11 and withdraws the wrench 80 from the bore 56, the arm 64 of the plunger 62 moves into the slot 76 as illustrated in FIGS. 10, 11 and 13. The spring 68 forces the plunger 62 outwardly as soon as the mechanic withdraws the wrench 80 from the bore 56 to move the arm 64 into the slot 76. This prevents rotation of the rotary element 54 until the mechanic once again pushes the socket of the wrench 80 into the bore 56 to open the mechanism. As shown in FIG. 14, the socket of the wrench 80 pushes against the plunger 62, forcing it inwardly to move the arm 64 into the slot 78 of the rotary element 54. Rotation of the rotary element 54 in a clockwise direction as viewed in FIG. 11 unlocks the mechanism moving the bolt member 14 to move linearly to the right as shown in FIG. 11. As soon as the cam reaches the fully open position, as shown in FIG. 15, the arm 64 of the plunger 62 is aligned with the indentation 44*a* in the surface 44 and snaps into position as shown in FIG. 17, providing a click sound, an audible signal to the mechanic indicating that the cam 42 is now in the fully opened position. At this point the cowling doors 20 can be manually moved apart to the phantom position shown in FIG. 1.

SCOPE OF THE INVENTION

The above description presents the best mode contemplated in carrying out the present invention as depicted by the embodiment enclosed. The combination of the features illustrated by this embodiment provides the user with an improved door closing and latching mechanism. This invention is, however, susceptible to both modifications and alternate constructions from the embodiment shown in the drawing and described above. Consequently, it is not the intention to limit it to the embodiment disclosed. On the contrary, the intention is to cover all modifications and alternate constructions falling within the scope of this invention as generally expressed by the following claims.

We claim:

1. A mechanism for closing and locking together two door members or the like, comprising:

bolt means projecting from a closing edge of one of the door members, receptacle means secured to a closing edge of the other door member, said receptacle means having a chamber therein with an open mouth disposed adjacent to the edge of the door member to which the receptacle means is attached, said bolt means and receptacle means being aligned with each other so that, upon closure of the door members, the closing edges of each of said members abut each other and said bolt means moves from a first position where said bolt means is at the mouth of said receptacle means to a second position where the bolt means is locked securely in the chamber of the receptacle means, said chamber including a manually rotatable element carrying cam means, with said rotatable element, upon being rotated, moving the cam means from a first position where said cam means is displaced away from the mouth of the receptacle means to allow entry of the bolt means to a second position where the cam means engages the bolt means and locks said bolt means into position, said bolt means including a cam surface which engages the cam means as said rotatable element moves said cam means between a first and second position, with said rotatable element being in an over center position when the cam means is in said second position, so that any force acting on the bolt means to pull it from the receptacle chamber causes the rotatable element to pull the cam means into the second position rather than out of the second position to thereby hold the bolt means securely in said second position, said cam means being adjacent the perimeter of the rotatable element and having an outer edge which has a curved shape corresponding to an arcuate segment of a circle whose center coincides with the point of rotation of the rotatable element, and said cam surface has a curved shape essentially complementary in shape to said outer edge, having its center coinciding with the point of rotation of the rotatable element upon movement of the cam means from the first position to the second position.

2. The mechanism of claim 1 including means for locking the rotatable element in place when the bolt means has been moved into its second position.

3. The mechanism of claim 2 wherein the locking means includes a spring actuated plunger member which under the force of the spring moves into a slot in the receptacle means to hold the rotatable element securely in place.

4. The mechanism of claim 1 including means providing an audible signal when the bolt means is in the second position securely locked in place.

5. The mechanism of claim 1 including means providing an audible signal when the cam has been moved to the first position.

6. A mechanism for closing and locking a door including:

a bolt member projecting from the closing edge of the door, door closing and latching means for edgewise reception of the bolt member, including a rotatable element engageable with the bolt member and being operable to move the bolt member substantially rectilinearly along a closing path from a partially open position to a fully closed position, said door closing and locking means including cam means which is moved to an over center position as the bolt member is moved to the locked position which acts against movement of the door in a reverse door opening direction, said cam means being adjacent the perimeter of the rotatable element and having an outer edge which has a curved shape corresponding to an arcuate segment of a circle whose center coincides with the point of rotation of the rotatable element, and said bolt member has a cam surface with a curved shape essentially complementary to the shape of said outer edge and its center coinciding with the point of rotation of the rotatable element upon movement of the cam means to the over center position, and said outer edge and said cam surface being in an abutting relationship upon movement of the cam means to said over center position.

7. The mechanism of claim 6 including a rotatable element which carries the cam means and is manually rotated using a wrench.

8. The mechanism of claim 7 wherein the rotatable element has associated therewith a locking device which locks the rotatable element in the locked position.

9. The mechanism of claim 7 including a receptacle which receives the bolt member, with the bolt member having predetermined dimensions which prevent substantial lateral movement of the bolt member within the receptacle but allow for rectilinear movement of the bolt member along the closing path.

10. The mechanism of claim 6 including means which provide an audible signal when the door closing and locking mechanism is in the locked position.

11. A mechanism for closing and locking together two door members or the like, comprising:

bolt means projecting from a closing edge of one of the door members and movable along a liner path of travel, receptacle means secured to a closing edge of the other door member, said receptacle means having an open mouth disposed adjacent to the edge of the door member to which the receptacle means is attached, said bolt means and receptacle means being aligned with each other so that, upon closure of the door members, the closing edges of each of said members that each other and said bolt means moves along said linear path from a first position where said bolt means is at the mouth of the receptacle means to a second position where the bolt means is locked securely in the receptacle means, and moved along said path of travel in one direction to a limit position, a manually rotatable element carrying at its perimeter cam means having an outer arcuate cam surface, with said rotatable element, upon being rotated, moving the cam means from a first position where said cam means is displaced away from the mouth of the receptacle means to allow entry of the bolt means to a second position where the cam means engages the bolt means and locks said bolt means into position, and an arcuate cam surface on the bolt means which engages the arcuate cam surface of the cam means as said rotatable element moves said cam means between a first and second position, with said rotatable element being in an over center position when the cam means is in said second position, so that any force acting on the bolt means to pull it from the receptacle means causes the rotatable element to pull the cam means into the second position rather than out of the second position to thereby hold the bolt means securely in said second position, and said arcuate surfaces abutting and interacting so that with the mechanism locked there is no movement of the bolt means from its limit position even though the rotatable element is in the over centered position.

* * * * *